United States Patent [19]

Hansler et al.

[11] Patent Number: 4,935,668

[45] Date of Patent: Jun. 19, 1990

[54] METAL HALIDE LAMP HAVING VACUUM SHROUD FOR IMPROVED PERFORMANCE

[75] Inventors: Richard L. Hansler, Pepper Pike; Park French, Aurora; John M. Davenport, Lyndhurst, all of Ohio

[73] Assignee: General Electric Company, Schenectady, N.Y.

[21] Appl. No.: 157,360

[22] Filed: Feb. 18, 1988

[51] Int. Cl.[5] ..... H01J 61/20; H01J 61/22

[52] U.S. Cl. ..... 315/82; 313/571; 313/634; 313/639; 313/562

[58] Field of Search ..... 313/571, 641, 642, 635, 313/636, 637, 638, 639, 640, 562, 113, 312, 634; 315/82, 358

[56] References Cited

U.S. PATENT DOCUMENTS

| | | | |
|---|---|---|---|
| 3,398,312 | 8/1968 | Edris et al. | 313/642 |
| 3,842,304 | 10/1974 | Beyer et al. | 313/635 |
| 4,197,480 | 4/1980 | Ryan, Jr. | 313/638 |
| 4,594,529 | 6/1986 | de Vrijer | 313/571 |
| 4,808,876 | 2/1989 | French et al. | 313/635 |

*Primary Examiner*—Eugene R. LaRoche
*Assistant Examiner*—Ali Neyzari
*Attorney, Agent, or Firm*—John P. McMahon; Stanley C. Corwin; Fred Jacob

[57] ABSTRACT

A metal halide lamp having a vacuum shroud is disclosed. The vacuum shroud substantially eliminates the detrimental catephoresis effects of operating a metal halide lamp from a low frequency alternating current (A.C.) source or direct current (D.C.) sources, reduces the sodium migration losses typically experienced with a metal halide lamp, reduces the photoelectrons contribution to sodium losses for the metal halide lamp, reduces the detrimental effects of the hydrogen and water that may be within the general confines of such a metal halide lamp, and provides a containment function for an inner envelope that may be operated at a relatively high pressure and possibly experience rupturing to cause the dislodgment of the ruptured material to possibly fracture a glass member confining the metal halide lamp.

23 Claims, 5 Drawing Sheets

METAL HALIDE LAMP HAVING VACUUM SHROUD FOR IMPROVED PERFORMANCE

CROSS REFERENCE TO RELATED APPLICATIONS

U.S. applications Ser. Nos., 157,359; and 157,436 filed herewith, respectively for "Xenon Lamp Particularly Suited For Automotive Applications" of Davenport and Hansler and "Xenon-Metal Halide Lamp Particularly Suited For Automotive Applications" of Bergman, Davenport, and Hansler all assigned to the same assignee as the present invention, are all related to the present invention.

BACKGROUND OF THE INVENTION

The present invention relates to a discharge lamp especially suited for forward lighting application of a vehicle such as an automobile, truck, bus, van or tractor. More particularly, the discharge lamp is a metal halide type which is particularly suited for a vehicle such as an automotive and has means for reducing the typically expected losses occurring during the operation of a metal halide lamp.

Automotive designers are interested in lowering the hood line of cars in order to improve their appearance and also their aerodynamic performance. As discussed in the cross-reference U.S. application Ser. No. 157,359, the amount that the hood lines may be lowered is limited by the dimensions of the automotive headlamp, which, in turn, is limited by the dimensions of the light source which is typically comprised of a tungsten filament.

U.S. applications having Ser. Nos. 157,359, and 157,436, respectively disclose a xenon lamp and a xenon-metal halide discharge lamp having dimensions which are substantially reduced relative to a tungsten light source, which, in turn, allow for the reduction of the overall size of the reflector of the automotive headlamp housing a light source so that the hood line of the automobile may be substantially reduced by the automotive designers. In addition to the xenon lamp and xenon-metal halide lamps, it is desired to provide a metal halide lamp for automotive applications so as to allow for aerodynamic styling of automobiles. Further, it is desired to provide for a xenon-metal halide lamp having improvements related to automotive and other applications. Still further, in addition to the metal halide light source serving the needs of automobile, it is desired that an improved metal halide light source find lighting applications in the home, office and other commercial and industrial usages.

In one lighting application particularly suited for automobiles, it is desired to provide a metal halide lamp that may be operated from a low frequency alternating current (A.C.) power source or direct current (D.C.) power source. In such A.C. and D.C. applications, the metal halide lamp typically experiences the effects of catephoresis which cause the halides of the metal halide lamp to be moved or swept into the end regions of the lamp so as not to contribute to providing the desired illumination of such lamp. It is desired that means be provided which substantially reduce or even eliminate the detrimental effect of catephoresis on the operation of the metal halide lamp.

A second disadvantage typically related to metal halide lamps, particularly metal halide lamps having relatively small dimensions so as to be adapted to automotive applications, is that these lamps typically include a sodium iodide as a part of their fill, and the sodium ions of this ingredient may migrate by electrolysis through the fused silica of the metal halide lamp during operation. As the sodium is lost and the free iodine of the sodium iodide is left behind in the lamp, the lamp illumination deteriorates through the loss of sodium radiation. The free iodine causes the operating voltage of such lamp to begin to rise which may ultimately cause the metal halide lamp to experience a failure. It is desired that means be provided to substantially reduce or eliminate the sodium ion migration problem typically associated with the operation of metal halide lamps.

A third disadvantage related to metal halide lamps, is concerned with the structure necessary for mounting the metal halide light source within an outer envelope so as to form the overall lamp. The structure, in particular a metal structure, when subjected to incident radiation emitted from the metal halide light source commonly causes the metal structural members to emit photoelectrons. Some of these photoelectrons drift to the outer surface of the metal halide light source, charging such a surface in a negative direction and accelerating the electrolysis of the sodium ions through the fused silica of the metal halide lamp. It is desired to minimize or reduce the metal structural members for mounting the metal halide light within its related lamp so as to correspondingly reduce the electrolysis of the sodium ions through the fused silica created by metal structural members which emit photoelectrons.

A further disadvantage related to metal halide lamps, is the disadvantageous feature created by the presence of hydrogen and water which may diffuse out of the metal halide lamp. It is desired that means be provided to reduce the detrimental effects of hydrogen and water without contributing to any further disadvantageous operation of the metal halide lamp such as the creation of photoelectrons that would otherwise cause the loss of the sodium ion from the metal halide lamp.

A still further disadvantage that may possibly occur with a halide lamp is related to the rupturing of the metal halide lamp that is typically operated at a relatively high pressure. Upon the limited possibility of such an occurrence, the high pressure within the metal halide lamp may cause the material of such a metal halide lamp to be dislodged at a relatively high velocity which may possibly fracture the outer envelope in which the metal halide lamp is housed. It is desired that confinement means be provided so as to reduce the possible effects of the rupturing of such a metal halide lamp operated at a relatively high pressure.

Accordingly, it is an object of the present invention to provide a metal halide lamp having means so as to reduce the detrimental effects of catephoresis typically created by low frequency A.C. operation or D.C. operation of such a lamp.

It is a further object of the present invention to provide means to reduce the sodium ion migration typically experienced for a metal halide lamp.

It is a further object of the present invention to reduce the sodium ion migration caused by metallic mounting members emitting photoelectrons which contribute to the loss of the sodium ions of the metal halide lamp.

It is still a further object of the present invention to provide containment means so as to reduce the possible detrimental effects that may occur during the unlikely event of the rupturing of the metal halide lamp operated at a relatively high pressure.

SUMMARY OF THE INVENTION

The present invention is directed to a metal halide light source having physical dimensions and operational characteristics finding various applications and which is particularly suited to serve as a light source for an automotive headlamp.

The metal halide light source comprises an inner envelope and a shroud member merged with the inner envelope. The inner envelope contains mercury along with a metal halide compound and may contain a xenon gas. The inner envelope has a pair of electrodes disposed therein and separated from each other by a predetermined distance. The electrodes have means for connecting to inleads which extend out of the inner envelope. The shroud member is merged with the inner envelope and separated from the side walls of the inner envelope by a predetermined distance to provide a chamber between the inner envelope and the shroud.

In one embodiment of the present invention the light source is used for an automotive headlamp which comprises a reflector having a predetermined focal length and focal point along with a section to which is mated means capable of being connected to an external source of the automobile. A lens is mated to the front section of the reflector and the light source is predeterminantly positioned within the reflector so as to be approximately disposed near the focal length of the reflector.

DETAILED DESCRIPTION OF THE PREFERRED EMBODIMENTS

Figure 1:
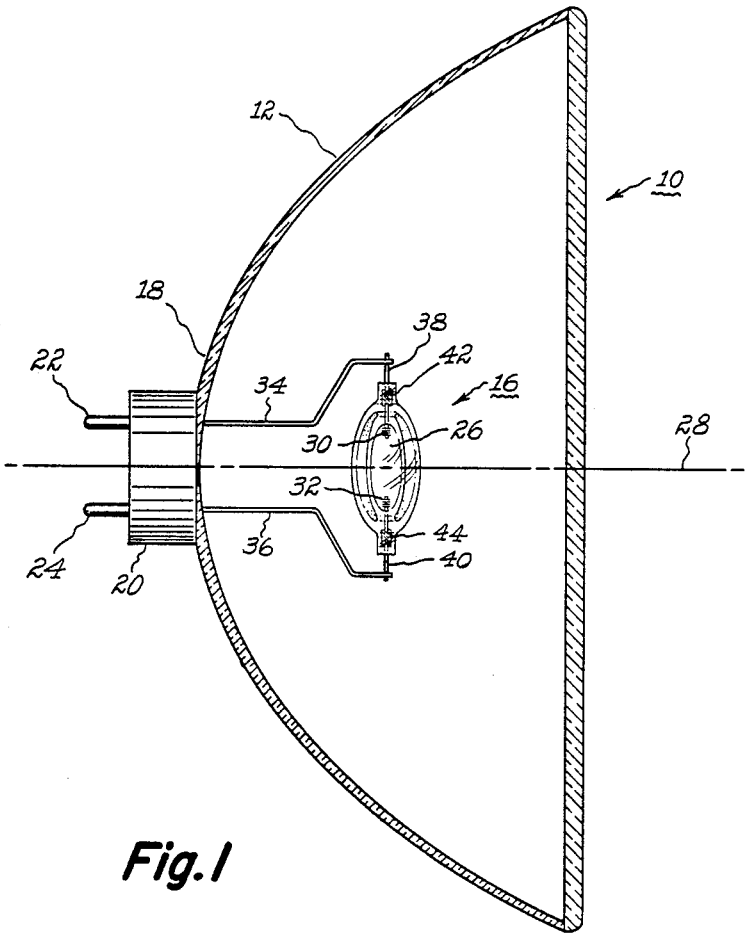
FIG. 1 is a side view generally illustrating an automotive headlamp in accordance with the present invention having its light source orientated in a vertical manner.

FIG. 1 is a side view generally illustrating an automotive headlamp 10 in accordance with one embodiment of the present invention. The automotive headlamp 10 comprises a reflector 12, a lens member 14 and a metal halide light source 16.

Figure 2:
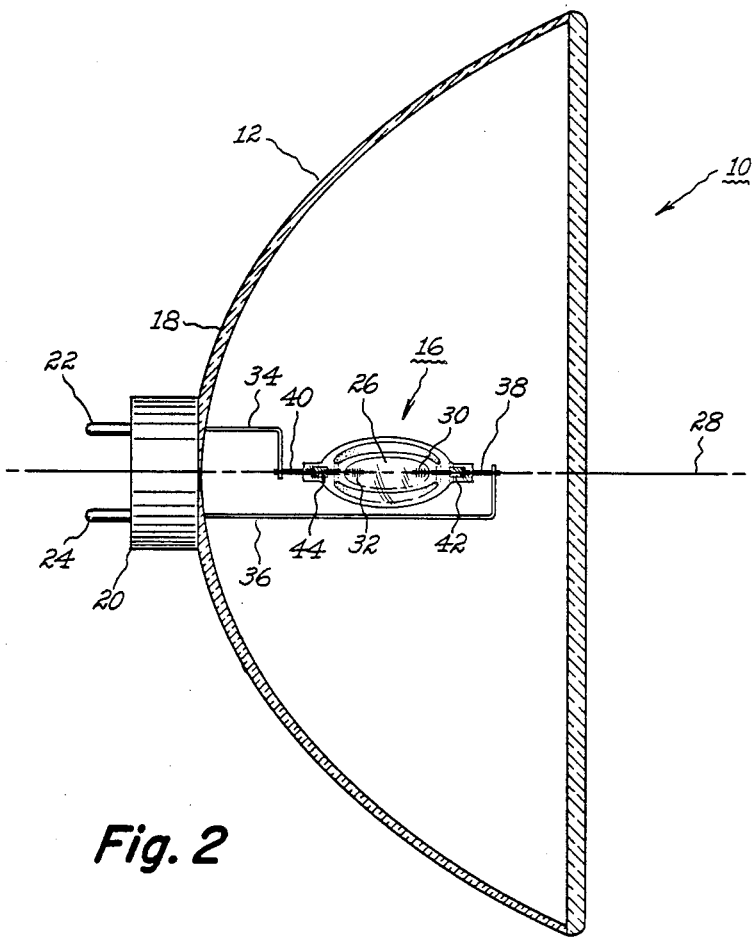
FIG. 2 is a top view generally illustrating an automotive headlamp in accordance with the present invention having its light source oriented in a horizontal axial manner.

The reflector 12 has a rear section 18 having means mounted thereon such as a connector 20 with prongs 22 and 24 capable of being connected to an external source of an automobile. The reflector 12 has a predetermined focal length 26 measured along the axis 28 of the automotive headlamp 10 and located at about the mid-portion of the light source 16. The light source 16 is predeterminedly positioned within the reflector 12 so as to be approximately disposed near the focal length 26 of the reflector. For the embodiment illustrated in FIG. 1, the light source 16 is oriented in a vertical and transverse manner relative to along the axis 28 of the reflector 12, whereas, FIG. 2 illustrates the light source 16 as being oriented in a horizontal manner relative to and along the axis 28 of the reflector 12.

The reflector 12 that cooperates with the light source 16 has a parabolic shape with a focal length in the range of about 6 mm to about 35 mm with a preferred range of about 8 mm to about 20 mm. The lens 14 is mated to the front section of the reflector 12. The lens 14 is of a transparent material selected from the group consisting of glass and plastic. The transparent member has a face preferably formed of prism members.

The light source 16 has a pair of electrodes 30 and 32 disposed at opposite ends thereof at its neck portions and separated from each other by a predetermined distance in the range of about 2 mm to about 10 mm. The light source 16 is connected to the rear section of the reflector 12 by means of relatively heavy inleads 34 and 36 each having one end respectively connected to electrodes 30 and 32 by respective inleads 38 and 40 and their other end respectively connected to prongs 22 and 24. The electrodes 30 and 32 are of a rod-like member formed of a material preferably selected from the group comprising tungsten and tungsten with 1–3% thorium oxide. Further the electrodes 30 and 32 are respectively connecting to the foil members 42 and 44 sealed in the neck portions for one embodiment of the present invention applicable to a quartz light source 16. Each of the foil members 42 and 44 are electrically connected to their respective inleads 38 and 40. For another embodiment related to light source 16 preferably of a type #180 glass available from the General Electric Company, the electrodes 30 and 32 may be a rod-like members preferably welded to molybdenum inleads which may be directly sealed in the #180 glass, thereby eliminating the need of foil members 42 and 44.

Figure 3:
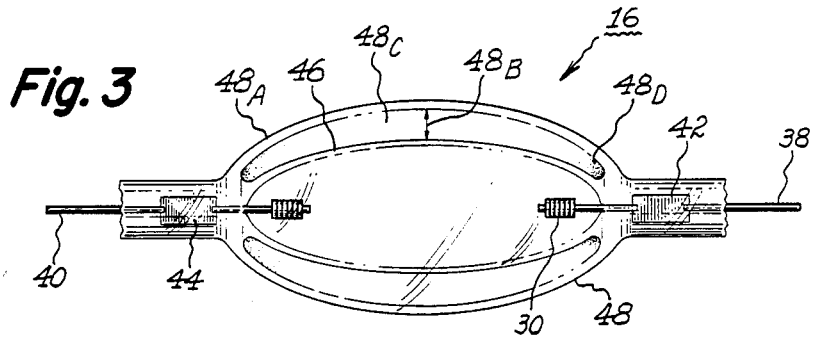
FIG. 3 illustrates the metal halide light source in accordance with the present invention having an inner envelope and a shroud member merged with the inner envelope.

The light source 16, shown in detail in FIG. 3, for one embodiment of the present invention, is comprised of a inner envelope 46 and a shroud member 48 which is integrated or merged with the inner envelope at a portion of each of the neck sections of the inner envelope so as to form one integral member.

As will be discussed hereinafter, one of the main advantages of the light source 16 having a vacuum shroud 48 is to produce an improved wall temperature over prior art devices by eliminating the cooling effects of gas conduction and convection. This improved uniform temperature results in more metal halide being vaporized and maintained in the discharge of the arc condition within light source 16 which improves the efficiency and color of the light source 16. This improved uniform temperature also makes the light source less dependent on its orientation within a housing such as within the automotive lamp 10. The vacuum shroud 48 also reduces the typically occurring catephoresis effects during D.C. and low frequency operating of the light source 16 by driving the metal halides out of the ends of the light source 16.

The inner envelope 46 of the light source 16 has a length in the range of about 8 mm to about 20 mm, sidewalls with a thickness in the range of about 0.4 mm to about 1.5 mm, neck portions with a diameter in the range of about 2 mm to about 6 mm and a central portion having an outer diameter in the range of about 4 mm to about 12 mm. The shroud member 48 has an overall length in the range of about 14 mm to about 30 mm, an outer diameter in the range of about 8 mm to about 20 mm and outer walls $48_A$ having a thickness in the range of about 0.4 mm to about 1.5 mm. The outer walls 48A are separated from the main sidewalls of the inner envelope 46 by a predetermined distance $48_B$ which is within the range of about 1 mm to about 5 mm. The separation between the inner envelope 46 and the outer walls $48_A$ provide a chamber $48_C$ between the inner envelope and the shroud member having a volumetric case capacity in the range of about 10 $mm^3$ to about 100 $mm^3$. The chamber $48_C$ is preferably evacuated and preferably contains a hydrogen and water getter $48_D$ that is dispersed about the inner surface of the outer walls $48_A$ and which is preferably comprised of chips of zirconium.

Figure 4:
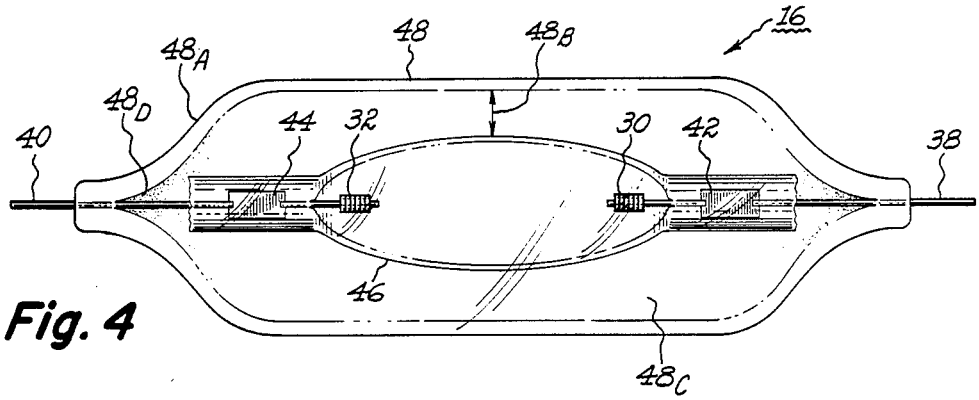
FIGS. 4 and 5 illustrate alternate embodiments of an inner envelope merged with a shroud member.
Figure 5:
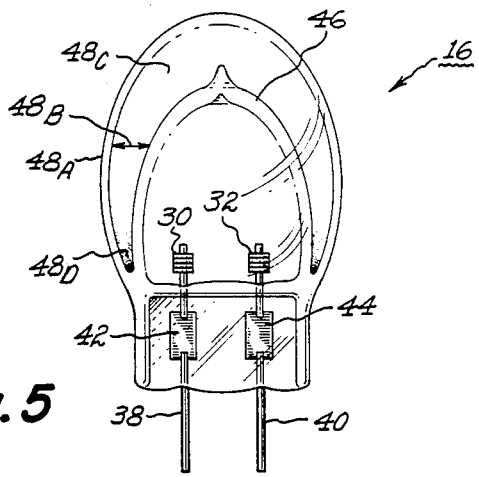

The light source 16 may have other embodiments such as shown in FIGS. 4 and 5 that use the same reference number for similar elements with similar dimensions and which are shown and described with regard to FIG. 3. FIG. 4 illustrates a light source 16 in which an inner envelope 46 formed of a quartz material is merged to a shroud 48 formed of a type #180 glass material and in which the inner leads 38 and 40 are sealed at opposite neck portions of the glass shroud 48. FIG. 5 illustrates a single-ended light source 16 in which the electrodes 30 and 32 are disposed and exit from the same end of the light source 16.

The light source 16 contains a fill consisting of mercury and a metal halide. The light source may also contain a xenon gas at a pressure at room temperature in the range of about 2 atmospheres to about 15 atmospheres. The mercury contained in the metal halide lamp is in an amount in the range of about 2 mg to about 10 mg. The amount of mercury is chosen so that with a bulb of a certain size and a distance between the electrodes of a certain amount the voltage drop across the lamp is a convenient value and such that the convection currents within the lamp that produce bowing of the arc do not produce excessive bowing. The operating pressure of the light source 16 is in the range of about 2 atmospheres to about 65 atmospheres. The metal halide is a mixture of an amount in the range of about 2 mg to about 50 mg. The mixture is comprised of halides selected from the group given in Table 1.

TABLE 1

| |
|---|
| Sodium Iodine |
| Scandium Iodine |
| Thallium Iodine |
| Indium Iodine |
| Tin Iodine |
| Dysprosium Iodine |
| Holmium Iodine |
| Thulium Iodine |
| Thorium Iodine |
| Cadmium Iodine |
| Cesium Iodine |

The metal halide light source 16 of the present invention does not suffer the disadvantages of previous metal halide lamps discussed in the "Background" section. More particularly, the light source 16 has means so as to (1) reduce the detrimental catephoresis effects suffered by the low frequency A.C. operation or D.C. operation of such a lamp; (2) reduce the sodium ion migration losses of the metal halide lamp; (3) reduce the sodium losses caused by the photoelectrons emission of metal structural members of the related lamp; (4) reduce the hydrogen-oxygen detrimental effects typically associated with a metal halide lamp; (5) simplify the mounting structure for the metal halide lamp; and (6 ) provide for containment of the particles created by the remote possibility of the rupturing of the metal halide lamp 16 operated at a relatively high pressure. In addition, the metal halide lamp because of its relatively small dimensions is particularly suited for reducing the overall dimensions of the related automotive headlamps finding application in aerodynamically styled automobiles.

Typically when small, wattage metal halide lamps not having the benefit of the present invention are operated from a relatively low frequency of an alternating current (A.C.) source such as 60 Hz or from a D.C. power source, the metal halide ions are influenced by the electric field created by these excitation and have enough time, for example, during each 60 Hz cycle to move a significant distance away from the electrodes of the lamp. The effect called catephoresis on these types of operation of the metal halide lamp is to gradually sweep the halides into the end regions of the lamp whereby these halides do not make a substantial contribution to the amount of halide occurring between the electrodes and therefore do not contribute to the illumination desired for these low wattage metal halide lamps. One of the contributing factors of such detrimental operation is that the convection effects on the outside of the metal halide lamp cool the lower region of the metal halide lamp which assists in condensing and drawing the metal halide ions away from their desired location between the electrodes.

The present invention surrounds the inner envelope with a vacuum shroud so that the temperature of the inner envelope is higher and more uniform by eliminating both gas conduction and convection losses. The structure of the light source 16 of the present invention being formed of the inner envelope and shroud member, each having the dimensions previously given along with the separation between electrodes, are selected to provide sufficient heat in the area of the inner envelope related to the separated electrodes that thermally causes a diffusion to drive or move the metal halide ions out of the end regions of the inner envelope at a rate sufficient to cancel effects of catephoresis.

The features of the present invention which reduce the detrimental catephoresis, conduction and convection effects are particularly advantageous in allowing the metal halide lamp to be oriented, in a horizontal or vertical arrangement relative to the base of the lamp in which it is housed, so that the overall lamp may be universally positioned to meet the various lighting fixture needs in which the lamp may find application.

The present invention also provides a solution for reducing the sodium ion migration problems typically experienced for metal halide lamps. As previously discussed, most metal halide lamps, including the present light source 16, include sodium iodide as a part of the fill and the sodium ions of such an ingredient migrate from the lamp by electrolysis through the fused silica during operation of such lamp. As the sodium ions are lost and free iodine is left behind in the arc tube, the desired illumination of the metal halide lamps deteriorates through the loss of sodium radiation, and in turn, the operating voltage of the metal halide lamp rises due to the free iodine, ultimately to a point of possible lamp failure.

The shroud member 48 of the light source 16, having the dimensions previously given, is of a sufficient importance in that the shroud member runs cool, relative to the inner envelope and thereby reduces the electrical conductivity of the shroud member by a sufficient amount, so that the sodium ions which diffuse through the inner envelope and settle on the inside wall of the shroud are not electrically neutralized, but rather produce a strong electric field which stops or opposes the motion of subsequent migrating sodium ions and thereby reduces and even avoids any further related sodium loss.

The light source 16 also reduces the sodium ion migration that may typically be caused by metallic members emitting photoelectrons when subjected to incident radiation emitted from the light source as discussed in the "Background" section. For example, some of the photoelectrons emitted from metallic members typically drift to the light source charging up the surface of the light source to a negative electrical potential which accelerates the electrolysis of the sodium ions from the fused silica. The present invention provides the shroud function without the need of any metallic members positioning the shroud around the inner envelope. The shroud 48 merged and sealed directly to the inner envelope thereby eliminating any metal that would otherwise produce photoelectrons that would disadvantageously contribute to the loss of sodium ions. The shroud also prevents any photoelectrons liberated from metal parts anywhere inside the outer jacket from reaching the inner quartz bulb.

The light source 16 of the present invention has its hydrogen and water getter $\mathbf{48}_D$, preferably comprised of chips of zirconium metal, confined within the shroud so as to reduce the detrimental effects of hydrogen and water which may diffuse out of the discharge lamp. These metal chips located in the chamber $\mathbf{48}_C$ are electrically floating, that is the chips do not have an established electrical potential, and therefore do not contribute to the problem of photoelectrons causing the migration of sodium ions.

A further advantage of the light source 16 is related to the containment provided by the vacuum shroud 48 being integrated with the inner envelope 46. The shroud 48, being placed about the inner envelope, that is normally operated at a relatively high pressure, retards or contains any possible fragmentation caused by the unlikely rupturing of the inner envelope. This containment helps in assisting the capturing of these fragments so as to prevent these fragments from fracturing the outer wall of an outer envelope that may be used to house the metal halide lamp of the present invention. This contribution is provided by having the space between the inner envelope and shroud evacuated so that it cancels some of the pressure from the inner envelope and tend to slow down any quartz or glass fragments that may be released from the unlikely rupture of the inner envelope.

A further feature of the present invention is that the shroud being formed with inner envelope simplifies the mounting of such a shroud within the confines of a lamp which houses the present invention.

It should now be appreciated that the present invention provides for a metal halide lamp having means to (1) reduce the detrimental catephoresis effects of operating such a lamp from a low frequency (A.C.) alternating current source or D.C. source, (2) reduce the typically experienced sodium migration problem from the inner envelope and prevents photoelectrons creating sodium ions losses, (3) provide for a containment function of a highly pressurized inner envelope, and (4) simplify the mounting of a shroud for a highly pressurized inner envelope.

The light source 16 of the present invention has further advantages featured over prior art metal halide lamps. One of these features is that the shroud 48 disturbs or spreads the heat generated within the inner envelope over a larger volume relative to the heat distribution confined to the inner envelope itself. This heat spreading is particularly advantageous to the plastic or sealing arrangement typically encountered within an automotive headlamp.

A further advantages is that the shroud 48 may be formed with a mixture containing titanium oxide which absorbs a substantial portion of the ultraviolet electromagnetic radiation generated by the discharge within the inner envelope 46 and thereby preventing such ultraviolet radiation from reaching and degrading the components comprising the automotive headlamp that are susceptible to such radiation.

The light source 16 is also advantageous to the placement of various coatings for different application. The surfaces of the shroud 48 are at a low temperature relative to the inner envelope 16 and more readily accommodates infrared reflective films and color films compared to the surfaces of the inner envelope 16 or other prior art metal halide lamps. The infrared films reflect the infrared radiation back toward the inner envelope and raises its temperature and thereby increasing its efficacy. The color film may be of a yellow type to provide corresponding yellow light advantageous for various lighting applications such as automotive lighting used in foreign countries such as France.

The low temperature of the shroud relative to the inner envelope is also beneficial in masking or controlling the light distribution for certain application such as automotive technology. For example, a black coating may be placed on one end of shroud to prevent light from being emitted from this end so as prevent this light from encountering and being reflected by a related portion of the reflector 12 that may produce unwanted or stray light for automotive applications. The lower temperature of the shroud 48 eases the problems of such placement of a black coating relative to being placed onto the inner envelope 46 or any known prior art metal halide light source.

The metal halide light source 16 may be advantageously operated by current interruption operating circuit disclosed in U.S. patent application Ser. No. 026,808 of K. A. Roll et al. filed Mar. 17, 1987, assigned to the same assignee as the present invention, herein incorporated by reference and to which reference may be made for further details of its operation. The current interrupt operating circuit controls the duty cycle of its described current interrupt switch so as to maintain a predetermined power level in the metal halide light source 16 of the present invention. As discussed in U.S. patent application Ser. No. 026,808, the system efficiency of operating a discharge lamp, such as the metal halide lamp 16, by means of current interruption is contemplated to be an improvement in excess of 50% relative to prior art methods of operating gas discharge devices.

Figure 6B:
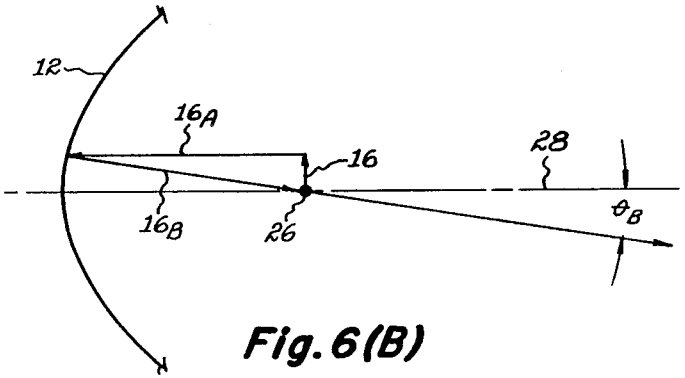
FIGS. 6(A) and 6(B) respectively illustrate a comparison between the beam divergence of an automotive headlamp system using an incandescent light source and the metal halide light source of the present invention in reflectors of the same size.
Figure 6A:
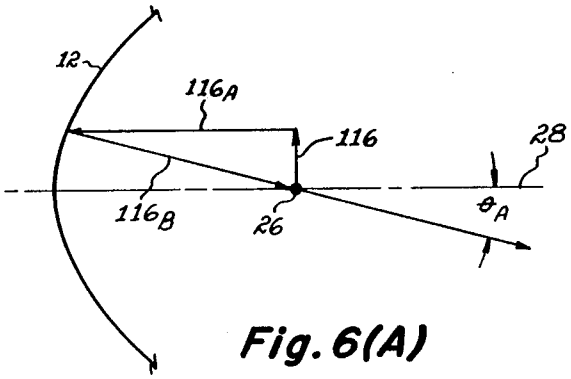

The metal halide lamp having relatively small dimensions, previously given, provides for a light source that is particularly suited for aerodynamically styled automobiles and may be described with reference to FIGS. 6(A) and 6(B). FIGS. 6(A) and 6(B) are interrelated and show a comparison of the divergence of the beam produced by a headlamp using a tungsten filament 116 compared to that produced by a headlamp having the smaller metal halide light source 16 of the present invention. FIG. 6(A) shows the light source 116 indicated in the form of an arrow having its mid-portion located the focal length 26 along the axis 28 of the reflector 12, whereas, FIG. 6(B) shows the light source 16 in the form of an arrow having its mid-portion located at the focal length 26 along the axis 28 of reflector 12 having the same dimensions as of FIG. 6(A). The incandescent light source 116 may have a length such as 5 mm as discussed with regard to FIG. 2, whereas, the light source 16 has a length of approximately 3 mm discussed with regard to FIGS. 3, 4, and 5.

The incandescent filament 116 when activated provides for a plurality of reflected light rays that diverge at a rate which is proportional to the size of the light source 116 and is represented by the angle $\theta_A$. Similarly, the xenon light source 16 provides for a plurality of light rays that diverge from each other by an angle $\theta_B$.

With reference to FIG. 6(A), the angle of divergence of the filament 116 is illustrated by a light ray $\mathbf{116}_A$ emitted from the upper most portion of filament 116 which is intercepted and reflected by reflector 12 as light ray $\mathbf{116}_B$. The angle between the light ray $\mathbf{116}_B$ which passes through the focal point 26 and the axis 28 is the divergence angle $\theta_A$ of filament 116. For the values previously given to the filament 116 (5 mm) and the reflector 12 (focal length 25 mm), this angle $\theta_A$ is 11.3°.

FIG. 6(B) shows light rays $\mathbf{16}_A$ and $\mathbf{16}_B$ which are similar to light rays $\mathbf{116}_A$ and $\mathbf{116}_B$ and describe with regard to FIG. 6(A). The angle of the divergence $\theta_B$ produced by the light rays emitted by the light source 16, for the previously given values of the light source 16 (3 mm) and the reflector 12 (focal length 25 mm), is 6.80°. The angle of divergence $\theta_B$ is approximately three-fifths smaller than the angle of the divergence $\theta_A$. The overall effect of such light produced by the light source 16 is that a desired beam pattern, developed by the automotive headlamp 10 of the present invention and directed to a roadway has less spread and may therefore be directed where it is needed to illuminate the road with less light where it is not wanted. The reduction of this spread or unwanted light by the metal halide light source 16, relative to an incandescent light source 116, reduces the veiling or concealing effect of fog, rain and snow and thereby provides more useful direct light for automotive applications.

Figure 7B:
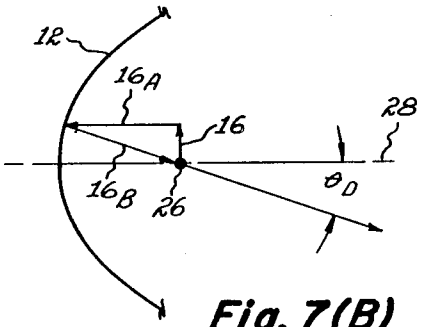
FIGS. 7(A) and 7(B) comparatively illustrate the size of the reflector needed for the use of an incandescent light source and the metal halide light source of the present invention in order to have the same light beam divergence.
Figure 7A:
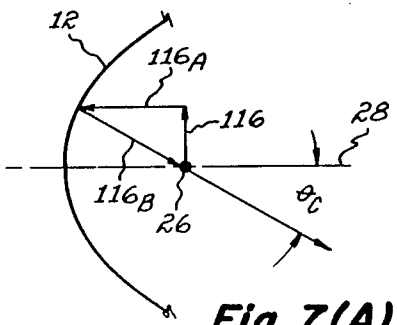

A further advantage provided by the relatively small size of the metal halide light source 16 is to reduce the necessary size of the reflector of the automotive headlamp and may be described with reference to FIGS. 7(A) and 7(B). FIGS. 7(A) and 7(B) are respectively similar to FIGS. 6(A) and 6(B) and use similar reference numbers where applicable. FIGS. 7(A) and 7(B) are different in that the focal length 26 has been reduced by a factor of two (2) relative to the focal length 26 respectively shown in FIGS. 6(A) and 6(B). Further the reflector 12 of FIGS. 7(A) and 7(B) has been reduced in height by a factor of about 2/3 relative to that of FIGS. 6(A) and 6(B).

FIG. 7(A) shows that the tungsten incandescent filament 116 produces light rays $\mathbf{116}_A$ and $\mathbf{116}_B$ in which ray $\mathbf{116}_B$ forms an angle of divergence $\theta_C$ having a value of about 21.8°for the reflector of FIGS. 7(A) and 7(B) and previously given values of filament 116 (5 mm length) which would produce stray light in a beam pattern of a sufficient amount that would not meet the needs of the automotive technology. Conversely, FIG. 7(B) shows the light source 16 of about 3 mm producing light rays $\mathbf{16}_A$ and $\mathbf{16}_B$ in which ray $\mathbf{16}_B$ forms an angle of divergence $\theta_D$ having a value of about 13.5°which produces a beam pattern having a limited amount of stray light so as to more than meet the needs of the automotive technology. The effect of the smaller size light source 16 allows for an increase in the collection efficiency of the reflector 12 through a reduction in its focal length and a slightly smaller reduction in its overall dimensions. The overall effect is that the light source 16 allows for both decreasing the size of the reflector and improving the collection efficiency of the reflector by sufficient amounts so as to allow the automotive designer to decrease the hood lines of the automobile as discussed in the "Background" section. It is contemplated that the practice of the present invention allows for a reduction of the reflector for an automotive headlamp by a factor of 2/3 relative to prior automotive headlamp utilizing a typical incandescent filament so that the hood lines of the automobile may be correspondingly reduced.

Figure 8A:
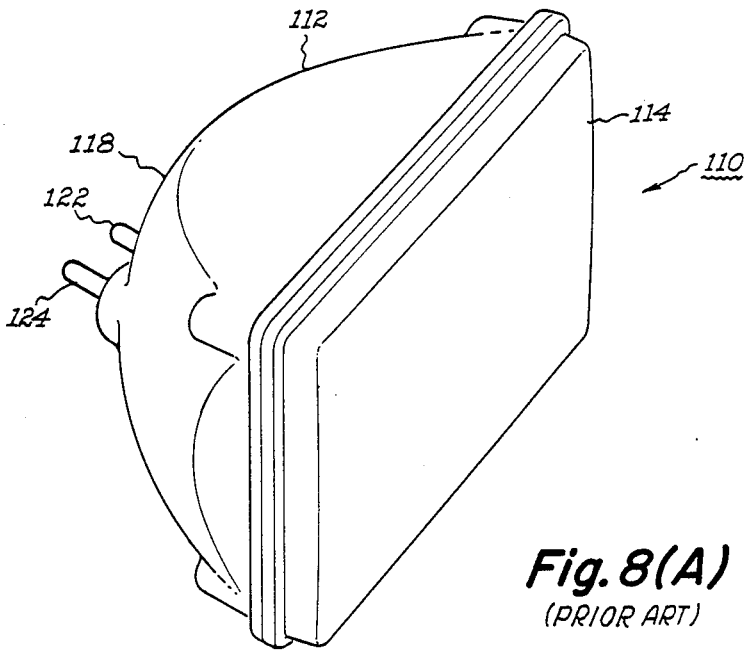
Fig. 8(A) (PRIOR ART)
FIGS. 8(A) and 8(B) are respective perspective views of a prior art rectangular automotive headlamp and a rectangular automotive headlamp in accordance with one embodiment of the present invention.
Figure 8B:
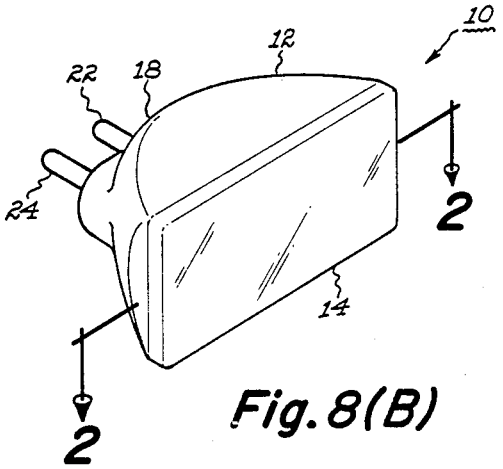

The overall reduction of the dimensions of the reflector and thereby the corresponding dimensions of the automotive headlamp may be illustrated with reference to FIGS. 8(A) and 8(B). FIG. 8(A) is a perspective view illustrative of a prior art rectangular automotive headlamp employing an incandescent filament and having similar elements of the automotive headlamp 10 of FIGS. 1 and 2 with corresponding reference numbers that have been increased by an amount of 100. FIG. 8(B) is a perspective view illustrative of one embodiment of the present invention being a rectangular automotive headlamp 10 shown in FIGS. 1 and 2 and having dimensions that have been reduced relative to the prior art lamp 110 by a factor of about 40% in accordance with the description of the lamp 10 given hereinbefore. From a comparison between FIG. 8(A) of the prior art lamp 110 and FIG. 8(B) is may be easily seen that the practice of the present invention provides the automotive designers with the means in the form of the light source 16 to substantially reduce the hood lines of the automobile.

It should now be appreciated that the present invention provides for a metal halide light source for an automotive headlamp that allows for substantial reductions in the hood line of the automobile. It should also be appreciated that the light source 16 of the present invention may contain a fill of xenon in the amount previously specified and obtain the benefits previous described herein in addition to the benefits described in the cross referenced U.S. patent application Ser. No. 157,436.

Although the previously given description of the metal halide lamp along with metal halide lamp having a fill of xenon was related to automotive application, it is contemplated that the practice of this invention is equally applicable to other various lighting applications. A significant feature of the present invention is that light is generated by metal halide lamp 16 having small dimensions relative to prior art metal halide lamps. The feature of providing discharge type lighting from the relatively small light source of the present light source allows it to be advantageously utilized in various lighting applications, homes, office and other various commercial and industrial environments and correspondingly reduce the related mounting and focussing arrangements.

What we claim as new and desire to secure by Letters Patent of the United States is:

1. A light source for a lamp comprising;

(A) an inner envelope having a pair of electrodes disposed therein and separated from each other by a predetermined distance;

said envelope containing a fill comprising;

mercury in an amount in the range of about 2 mg to about 10 mg; and a mixture of an amount in the range of about 2 mg to about 50 mg, said mixture selected from the group consisting of sodium iodine, scandium iodine; thallium iodine; indium iodine; tin iodine; dysprosium iodine iodine; holmium iodine; thulium iodine; thorium iodine, cadmium iodine, and cesium iodine and (B) a shroud merged with said inner envelope and separated from sidewalls of said inner envelope by a predetermined distance so as to provide a chamber between the inner envelope and said shroud, said chamber being evacuated and containing a hydrogen and water getter.

2. A light source according to claim 1 wherein said fill further includes a xenon gas at a pressure at a room temperature in the range of about 2 atmospheres to about 15 atmospheres.

3. A light source according to claim 1 wherein said inner envelope has an operating pressure in the range from about 2 atmospheres to about 65 atmospheres.

4. A light source according to claim 1 wherein said getter comprises chips of zirconium.

5. A light source according to claim 1 comprised of a material selected from a group consisting of glass and quartz.

6. A light source according to claim 1 wherein said inner envelope is comprised of;

(A) a length in the range of about 8 mm to about 20 mm;

(B) said sidewalls having a thickness in the range of about 0.4 mm to about 1.5 mm;

(C) said neck portions having an outer diameter in the range of about 2 mm to about 6 mm.

(D) a central portion having an outer diameter in the range of about 4 mm to about 12 mm.

7. A light source according to claim 1 wherein said disposed electrodes comprises;

a pair of rod-like members formed of a material selected from the group consisting of tungsten and tungsten with 1 % to 3 % thorium oxide, said rod-like members being electrically connected by means to respective inleads.

8. A light source according to claim 5 wherein said electrodes are disposed at opposed ends of said inner envelope.

9. A light source according to claim 5 wherein said electrodes are both disposed at one end of said inner envelope.

10. A light source according to claim 1 wherein said shroud is coated with a multi-layer infrared reflecting film.

11. A light source according to claim 10 wherein said infrared film reflects infrared radiation back toward the inner envelope.

12. A light source according to claim 1 wherein said shroud is coated with a colored film.

13. A light source according to claim 12 wherein said colored film is yellow.

14. A light source according to claim 1 wherein said shroud is of a mixture containing titanium oxide.

15. A light source according to claim 1 wherein said shroud has one of its ends with a coating of a black material.

16. A light source according to claim 1 wherein said electrodes are separated by said distance in the range of about 2 mm to about 10 mm.

17. A light source according to claim 1 wherein said shroud comprises;

(A) a length in the range of about 14 mm to about 30 mm;

(B) sidewalls having a thickness in the range of about 0.4 mm to about 1.5 mm; and (C) an outer diameter in the range of about 8 mm to about 20 mm.

18. A light source according to claim 17 wherein said shroud is separated from said sidewalls of said inner envelope by said predetermined distance in the range of about 1 mm to about 5 mm; and said chamber has a volumetric capacity in the range of about 10 $mm^3$ to about 100 $mm^3$.

19. An automotive headlamp comprising;

(A) a reflector having a section to which is mated means capable of being connected to an excitation source of an automobile, said reflector having a predetermined focal length and focal point;

(B) a lens mated to the front section of said reflector; and (C) an inner envelope predeterminently positioned within said reflector so as to be approximately disposed near said focal length of said reflector, (D) a shroud merged with said inner envelope and separated from sidewalls of said inner envelope by a predetermined distance so as to provide a chamber between the inner envelope and said shroud, said chamber being evacuated and containing a hydrogen and water getter;

said inner envelope containing a fill comprising;

mercury in an amount in the range of about 2 mg to about 10 mg and a mixture of an amount in the range of about 2 mg to about 50 mg, said mixture selected from the group consisting of sodium iodine, scandium iodine, thallium iodine, indium iodine, tin iodine, dysprosium iodine, holmium iodine, thulium iodine, thorium iodine, cadmium iodine and cesium iodine, said inner envelope having a pair of electrodes separated from each other by a predetermined distance, said inner envelope being connected to said means mated to said section so that said excitation source is capable of being applied across said electrodes, whereby upon such application said mercury and said mixture contained in said inner envelope is excited to as to produce a significant amount of light that is located between said electrodes.

20. An automotive headlamp according to claim 19 wherein said high intensity source of light in cooperation with said reflector provides for a plurality of reflected light rays, serving as the light beam, that diverge from each other by an angle having a value which is less than about 7°.

21. An automotive headlamp according to claim 19 wherein said fill further includes a xenon gas at a pressure at room temperature in the range of about 2 atmospheres to about 15 atmospheres.

22. An automotive headlamp according to claim 19 wherein said reflector comprises;

a parabola of revolution having a focal length in the range from 8 mm to 20 mm.

23. An automotive headlamp according to claim 19 wherein said lens comprises;

(A) a transparent member formed of a material selected from the group consisting of glass and plastic, said transparent member having a face with prism shaped members.

* * * * *